US006056464A

United States Patent [19]

Cohen

[11] Patent Number: 6,056,464

[45] Date of Patent: May 2, 2000

[54] PEN ORNAMENTATION DEVICE

[76] Inventor: Wayne Cohen, 44 Convent Road Silum, Bangrak, Bangkok, Thailand, 10500

[21] Appl. No.: 09/334,534

[22] Filed: Jun. 16, 1999

[51] Int. Cl.[7] ..... B43K 25/00

[52] U.S. Cl. ..... 401/52; 401/195

[58] Field of Search ..... 401/52, 195, 49, 401/209

[56] References Cited

U.S. PATENT DOCUMENTS 1,271,430 7/1918 Bush ..... 401/195

4,530,503 7/1985 Rice ..... 401/195

5,328,172 7/1994 Jagiella ..... 401/195

*Primary Examiner*—David J. Walczak

*Attorney, Agent, or Firm*—Baker Botts

[57] ABSTRACT

A novelty attachment for a pen or pencil is formed as a hollow shell with sounding beads therein. The shell is formed of a hollow member with a cylindrical extension and a generally cylindrical cap member having a flange with a circular recess for receiving the cylindrical extension. The cap member has an open outer end for receiving a pen or pencil.

4 Claims, 2 Drawing Sheets

PEN ORNAMENTATION DEVICE

BACKGROUND OF INVENTION

The present invention relates to novelty items which may be attached to the end of a pencil or pen.

It is an object of the invention to provide a new novelty attachment for a pencil or pen that include a hollow shell with sounding beads which, when attached to a pen or pencil can act as a maraca or rattle. It is a further object to provide a strong and inexpensive structural arrangement for such novelty attachment.

SUMMARY OF THE INVENTION

In accordance with the invention there is provided a novelty attachment for a pen or pencil comprising a hollow shell with sounding beads therein. The shell includes a hollow member with a cylindrical extension surrounding an opening. A cap member is formed as a generally cylindrical member having a closed end, an open end and a flange surrounding the open end. The flange extends outwardly and toward the closed end to form a cylindrical recess. The cap member is sized to be received in the cylindrical extension with the open end of the cylindrical extension being received in the cylindrical recess and the closed end of the generally cylindrical member within the hollow member. The generally cylindrical member is internally sized to receive an end of a pen or pencil.

The generally cylindrical member may have an internal taper to function as a cap for the writing end of a pen or pencil. In another arrangement the generally cylindrical member can be provided with internal protrusions for gripping the end of a pen or pencil. The hollow member may be formed of blow molded plastic.

For a better understanding of the present invention together with other and further objects, reference is made to the following description, taken in conjunction with the accompanying drawing and its scope will be pointed out in the appended claims.

DESCRIPTION OF THE INVENTION

Figure 1:
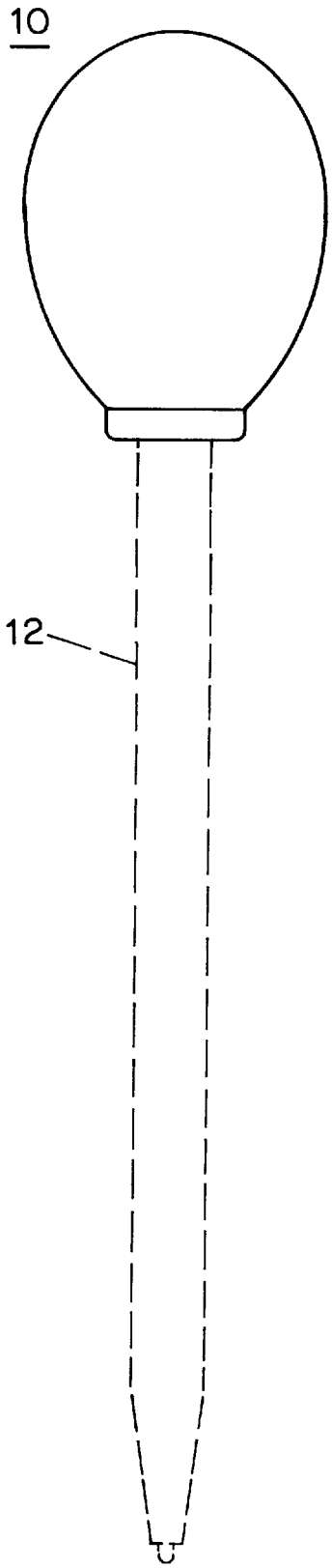
FIG. 1 is an elevation view of a first embodiment of the invention.
Figure 2:
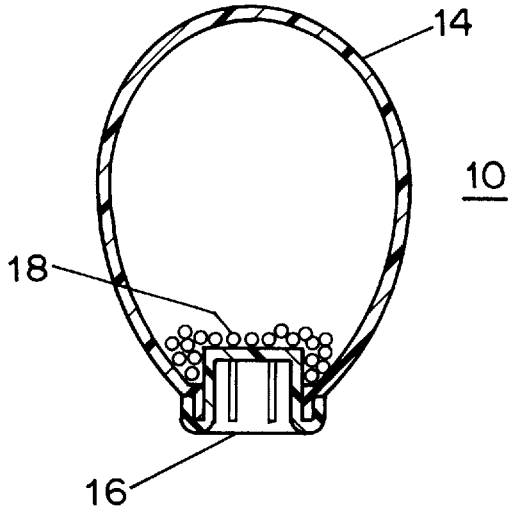
FIG. 2 is a cross-sectional view of the FIG. 1 embodiment.
Figure 6:
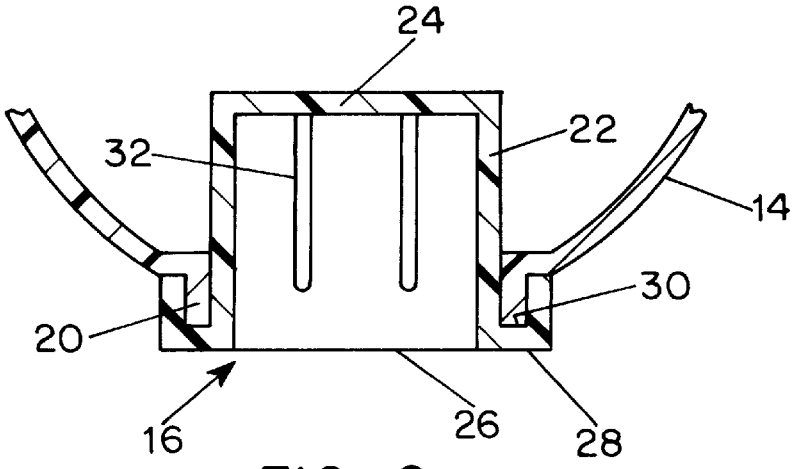
FIG. 6 is a detailed view of the FIG. 2 or FIG. 5 cross-sectional views.

Referring to FIGS. 1, 2 and 6, there is shown a novelty attachment 10 for the end of a pen or pencil 12. Attachment 10 is in the form of a small maraca without a handle, and when attached to a pen or pencil may be shaken to produce a maraca rattle sound. Attachment 10 of FIGS. 1 and 2 is circular in configuration and is formed of a hollow member 14, which may be blow-molded plastic. Member 14 is closed at the bottom end by cap member 16 to form a closed hollow shell with sounding beads 18 therein.

Referring to the detailed view of FIG. 6, the opening of hollow member 14 is formed with a cylindrical extension 20, which is preferably an integral part of member 14. Cylindrical extension 20 surrounds an opening in member 14 by which beads may be inserted. Cap member 16 is a generally cylindrical member having cylindrical walls 22, a closed end 24 and an open end 26. A flange 28, preferably integral with the cylindrical member 16, extends outward from open end 26 and toward closed end 24 to form a cylindrical recess 30, into which cylindrical extension 20 is received.

Cylindrical member 16 has a cylindrical wall 22 which is internally sized to receive the end of a pen or pencil. In one arrangement internal protrusions, such as ridges 32 are provided to grip the end of a pen or pencil. The outer diameter of cylindrical wall 22 is sized to fit closely within cylindrical extension 20, and cylindrical recess 30 is sized to receive cylindrical extension 20. Naturally, the diameter of cylindrical extension 20 must be consistent with the pen or pencil internal diameter of cylindrical member 16 and its wall thickness. Cylindrical member 16 is preferably plastic and may be made by any suitable fabrication process for such parts, such as injection molding. Cap member 16 is preferably joined to hollow member 14 by using adhesive in cylindrical recess 30.

While extension 20 and cap member 16 have been described as "cylindrical", this term is used in a broad sense to include arrangements that may not be circular in cross-section. For example, cap member 16 and extension 20 may be hexagonal in cross-section to receive a hexagonal cross-section pen or pencil. It is also possible to use a non-circular cross-section with a circular pen or pencil or to use a circular cross-section with a non-circular pen or pencil.

Figure 7:
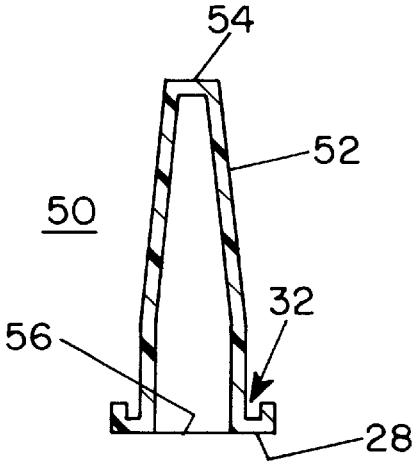
FIG. 7 is a cross-sectional view of an alterative cap member usable with the FIG. 1 or FIG. 3 embodiments.

The embodiment 10 described thus far is intended to be attached to the non-writing end of a pen or pencil, by friction fit or by adhesive attachment. An alternative cap member 50 is shown in FIG. 7, which is arranged for similar attachment to a hollow member 14, but is arranged to alternately close the writing end of a pen or a pencil or to be attached to the non-writing end when the pen or pencil is being used. The cylindrical sidewall 52 of cap 50 is tapered toward closed end 54 to grip the pen or pencil end in a manner than is similar to a conventional pen cap. Open end 56 of cap 50 is sized to receive the pen or pencil. Accordingly, the arrangement of cap 50 is "generally cylindrical" in the sense that its cross-section diameter is tapered. The flange 28 and cylindrical recess 32 of cap 50 are similar in form and function to those of cap 16.

Figure 3:
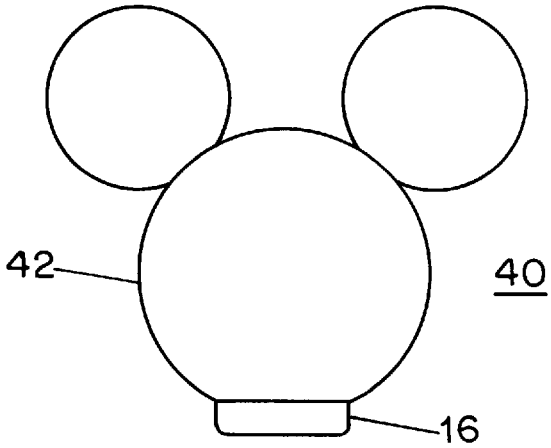
FIG. 3 is a front elevation view of a second embodiment of the invention.
Figure 4:
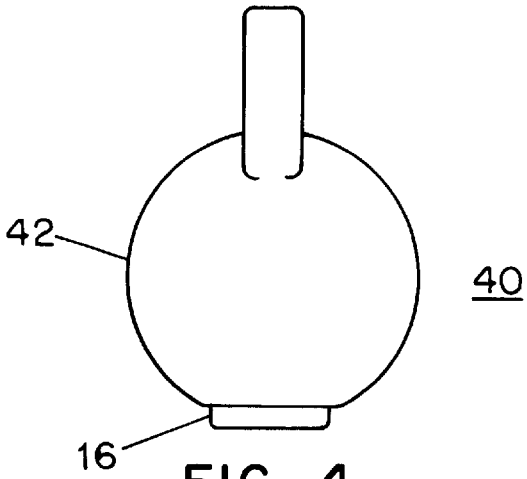
FIG. 4 is a side elevation view of the FIG. 3 embodiment.
Figure 5:
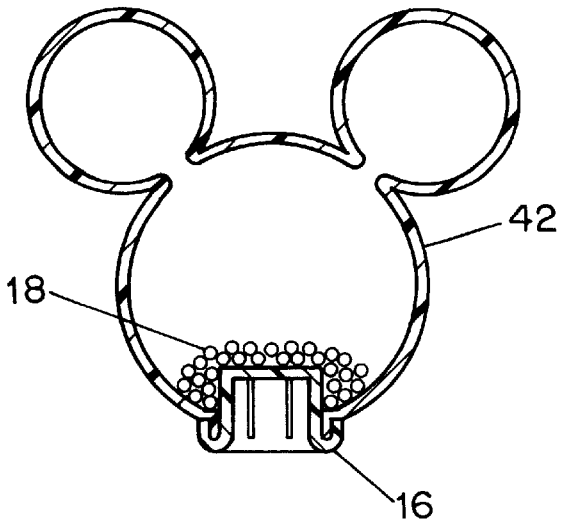
FIG. 5 is a cross-sectional view of the FIG. 3 embodiment.

FIGS. 3 to 5 illustrate a further attachment 40, wherein the hollow member 42 is specially shaped, for example, in the form of a cartoon character's head. The attachment 40 include the same cap member 16 surrounding a cylindrical extension having an opening. It will be recognized that as an alternative cap member 50 can be used with hollow member 42.

It will also be recognized that a wide variety of novelty shapes can be used for the hollow member to provide a variety of items, such as children's souvenirs depicting clowns, animals, cartoon characters, Santa Clause, rockets, airplanes and the like.

While there have been described what are believed to be the preferred embodiments of the present invention, those skilled in the art will recognize that other and further modifications may be made thereto without departing form the spirit of the invention, and it is intended to claim all such changes and modifications a fall within the true scope of the invention.

I claim:

1. A novelty attachment for a pen or pencil comprising a closed hollow shell with sounding beads, therein, said shell comprising a hollow member with a cylindrical extension surrounding an opening and a cap member, said cap member comprising a generally cylindrical member having a closed end, an open end and a flange surrounding said open and, said flange extending outwardly and toward said closed end to form a cylindrical recess, said cap member being sized to be received in said cylindrical extension with the open end of said cylindrical extension being received in said cylindrical recess and said closed end of said generally cylindrical member within said hollow member, said generally cylindrical member being internally sized for receiving an end of a pen or pencil.

2. A novelty attachment as specified in claim 1 wherein a least a portion of said generally cylindrical member is tapered toward a smaller diameter at said closed end.

3. A novelty attachment as specified in claim 1 wherein said generally cylindrical member has internal protrusion for gripping said pen or pencil.

4. A novelty attachment as specified in claim 1 wherein said hollow member is blow-molded plastic.

* * * * *